US005851498A

United States Patent [19]

Rozenshtein et al.

[11] Patent Number: 5,851,498

[45] Date of Patent: Dec. 22, 1998

[54] BOILER HEATED BY CATALYTIC COMBUSTION

[75] Inventors: Vladimir Rozenshtein, Givon Hahadasha; Yehuda Heimlich, Mevasseret Zion, both of Israel

[73] Assignee: Catalytic Systems Technologies, Ltd., Jerusalem, Israel

[21] Appl. No.: 759,341

[22] Filed: Dec. 2, 1996

[51] Int. Cl.[6] ..... F22B 1/00; B01J 8/00

[52] U.S. Cl. ..... 422/211; 422/173; 422/174; 422/198; 422/199; 122/4 D; 126/92 B; 126/92 AC; 432/29; 432/31; 431/268

[58] Field of Search ..... 422/211, 173, 422/202, 177, 186, 198, 186.3, 174, 199; 122/4 D; 431/7, 268, 277; 126/92 B, 92 AC; 110/345; 432/29, 31

[56] References Cited

U.S. PATENT DOCUMENTS

| | | | |
|---|---|---|---|
| 3,037,554 | 6/1962 | Risse | 431/268 |
| 3,057,400 | 10/1962 | Wagner | 431/268 |
| 3,073,379 | 1/1963 | Martin | 431/268 |
| 3,198,240 | 8/1965 | Keith et al. | 431/268 |
| 4,368,029 | 1/1983 | Lacroix | 431/7 |
| 4,676,222 | 6/1987 | Jones et al. | 126/92 B |
| 4,798,192 | 1/1989 | Maruko | 126/92 AC |
| 4,953,512 | 9/1990 | Italiano | 122/4 D |
| 4,985,208 | 1/1991 | Sugawara et al. | 422/202 |
| 5,211,552 | 5/1993 | Krill et al. | 431/7 |
| 5,560,823 | 10/1996 | Whiting | 422/202 |

*Primary Examiner*—Hien Tran
*Attorney, Agent, or Firm*—Mark M. Friedman

[57] ABSTRACT

A catalytic heater includes a catalyst, for the combustion of a gaseous hydrocarbon in air, supported on a catalyst support. Fuel diffuses into the catalyst support from one (proximal) side. Air diffuses into the catalyst support from the other (distal) side. The catalytic combustion of the fuel heats the catalyst support. The resulting infrared radiation from the distal side of the catalyst support is directed at an object to be heated, for example the fluid chamber of a boiler. A modular boiler includes several catalytic heaters, with the distal sides of their catalyst supports facing a chamber wherethrough a fluid such as water is conducted and heated by the infrared radiation from the heaters.

12 Claims, 3 Drawing Sheets

BOILER HEATED BY CATALYTIC COMBUSTION

FIELD AND BACKGROUND OF THE INVENTION

The present invention relates to a boiler for heating a fluid, and, more particularly, a boiler in which the fluid is heated by infrared radiation from the catalytic combustion of a gaseous hydrocarbon fuel in air.

In conventional boilers, a fluid such as water is heated by the heat provided by burning a liquid or gaseous fuel, such as fuel oil or natural gas, in the surrounding air. The flame associated with this burning typically has a temperature of between 1300° C. and 1900° C. These high temperatures lead to certain drawbacks. First, the burners of conventional boiler must be specially constructed to withstand these high temperatures. A burner often deteriorates over its operational lifetime, leading to the production of pollutants such as carbon monoxide and soot. Even under pristine operating conditions, the high temperature of combustion in a conventional boiler produces other pollutants such as nitrogen oxides. To prevent thermal damage to the heat exchanger of a conventional boiler, either that heat exchanger must be positioned a certain distance away from the flame, or extra air must be mixed with the combustion gases of the flame. Either expedient reduces the efficiency of the boiler.

These problems have been addressed by Italiano, in U.S. Pat. No. 4,953,512, and by Viani, in U.S. Pat. No. 4,886,017. Both Italiano's boiler and Viani's boiler use a catalyst to promote the flameless reaction of gaseous methane fuel with atmospheric oxygen, at a temperature typically between 400° C. and 700° C., which is cool enough to preclude either significant thermal damage to the structure of the boiler or the formation of nitrogen oxides. In both boilers, the catalyst is contained within a central chamber. In Italiano's boiler, the fluid to be heated is contained in a coil or a jacket outside the central chamber, and is heated by the conduction of combustion heat from the central chamber. In Viani's boiler, the fluid to be heated is conducted through the central chamber via pipes, or the central chamber is in the form of tubes running through a fluid container; in either case, the fluid again is heated by conduction. Italiano's catalyst consists of one or more metal oxides. Viani's catalyst is a platinum group metal.

Both Italiano's boiler and Viani's boiler suffer from certain limitations that restrict their flexibility. Both boilers require methane fuel, and air or oxygen must be provided in a near-stoichiometric ratio. In both boilers, fuel and air are mixed before being introduced to the catalyst chamber. In case of boiler malfuhction, this mixture may explode, making these boilers dangerously unsuitable for domestic use. In both boilers, the catalyst chamber is an integral part of the construction of the boiler, so that it is more difficult to control the operation of the boiler by varying the amount of catalyst, or to replace spent catalyst, than would be the case if the boiler were of modular construction, so that the number of catalyst-bearing members could be varied to suit particular applications.

There is thus a widely recognized need for, and it would be highly advantageous to have, a catalytic boiler of modular construction that can use a wide variety of fuel, not just methane.

SUMMARY OF THE INVENTION

According to the present invention there is provided a heater, wherein a gaseous hydrocarbon fuel is reacted catalytically with atmospheric oxygen, comprising: (a) a catalyst support having a proximal side; (b) a catalyst, for the reaction, supported on the catalyst support; and (c) a mechanism for delivering the fuel to the proximal side of the catalyst support.

According to the present invention there is provided a boiler for heating a fluid by infrared radiation from a catalytic reaction of a gaseous hydrocarbon fuel and atmospheric oxygen, comprising: (a) a chamber, for the fluid, having a wall; and (b) a heater including: (i) a catalyst support having a proximal side and a distal side, (ii) a catalyst, for the reaction, supported on said catalyst support, and (iii) a mechanism for delivering the fuel to said proximal side of said catalyst support; said heater being mounted outside said chamber with said distal side of said catalyst support facing said chamber, said distal side of said catalyst support and said wall of said chamber defining a gap therebetween.

According to the present invention there is provided a method for heating a fluid, comprising the steps of: (a) introducing the fluid into a chamber; (b) providing a heater wherein a gaseous hydrocarbon fuel reacts catalytically with atmospheric oxygen, the heater including: (i) a catalyst support having a proximal side and a distal side, (ii) a catalyst, for the reaction, supported on the catalyst support, and (iii) a delivery mechanism for delivering the fuel to the proximal side of the catalyst support; (c) mounting the heater outside the chamber so that the distal side of the catalyst support faces the chamber, there being a gap between the distal side of the catalyst support and the chamber; (d) introducing the fuel to the catalyst support via the delivery mechanism.

According to the present invention there is provided an appliance comprising a heater wherein a gaseous hydrocarbon fuel reacts with atmospheric oxygen, the heater including: (a) a catalyst support having a proximal side and a distal side; (b) a catalyst, for the reaction, supported on the catalyst support; and (c) a mechanism for delivering the fuel to the proximal side of the catalyst support.

According to the present invention there is provided a method for creating a supported cobalt chromium oxide spinel catalyst, the spinel having a tetrahedral sublattice and an octahedral sublattice, comprising the steps of: (a) providing a support material; (b) dissolving a soluble chromium salt and a soluble cobalt salt in water, thereby creating a solution; (c) saturating the support material with the solution; (d) drying the saturated support material; and (e) calcining the dried support material.

The boiler of the present invention is based on a catalytic heater that includes a catalyst supported on a thin catalyst support. A gaseous hydrocarbon fuel is delivered to one (proximal) side of the support. Air diffuses to the catalyst via the other (distal) side of the support. This strict separation of fuel supply and air supply makes the boiler of the present invention much more resistant to accidental explosions than the prior art boilers. The air and the fuel react on the surface of the catalyst, heating the catalyst support to a temperature of between 400° C. and 750° C., depending on the type of fuel used. At that temperature, the distal side of the support emits infrared radiation, predominantly at wavelengths between 2 microns and 16 microns. One or more of the heaters is positioned around a fluid-containing chamber, with the distal sides of the catalyst supports facing the chamber. The chamber and the fluid within is heated, predominantly by the infrared radiation from the heaters, but also by contact with hot gaseous combustion products (steam and carbon dioxide) diffusing out of the catalyst supports.

The boiler of the present invention is modular, in the sense that as few or as many heaters may be included as are needed for any particular application. For example, a water boiler may be configured with a small number of heaters to provide hot water, or a larger number of heaters to provide steam. In addition, in a multiheater boiler, a heater may be removed for maintenance, for example to replace spent catalyst, without totally disabling the boiler.

Although the scope of the present invention includes all suitable catalyst supports and all suitable catalysts, the preferred support is woven silica or alumina fibers, and the preferred catalyst is cobalt chromium oxide spinel. With this catalyst, and with a suitably dimensioned catalyst support, no special provision need be made for delivery of air in stoichiometric amounts to the heaters. The modular heater of the present invention works well in ambient air, even with a fuel delivery rate such that air diffuses to the catalyst in amounts far in excess of stoichiometric. In addition, this catalyst allows the use of any gaseous hydrocarbon fuel, including, for example, methane, ethane, propane, and butane.

The scope of the present invention includes the catalytic heaters themselves, a boiler based on the heaters, and indeed any appliance, such as a gas-powered air conditioner, which includes the heaters.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a catalytic heater, and of a modular boiler based on that heater. Specifically, the boiler of the present invention can be used to heat a fluid such as water, using a wide variety of fuels, without any special provision for controlling the fuel-air ratio, and with minimal down-time for servicing the heater modules of the boiler.

The principles and operation of a catalytic heater and a modular boiler according to the present invention may be better understood with reference to the drawings and the accompanying description.

Figure 1:
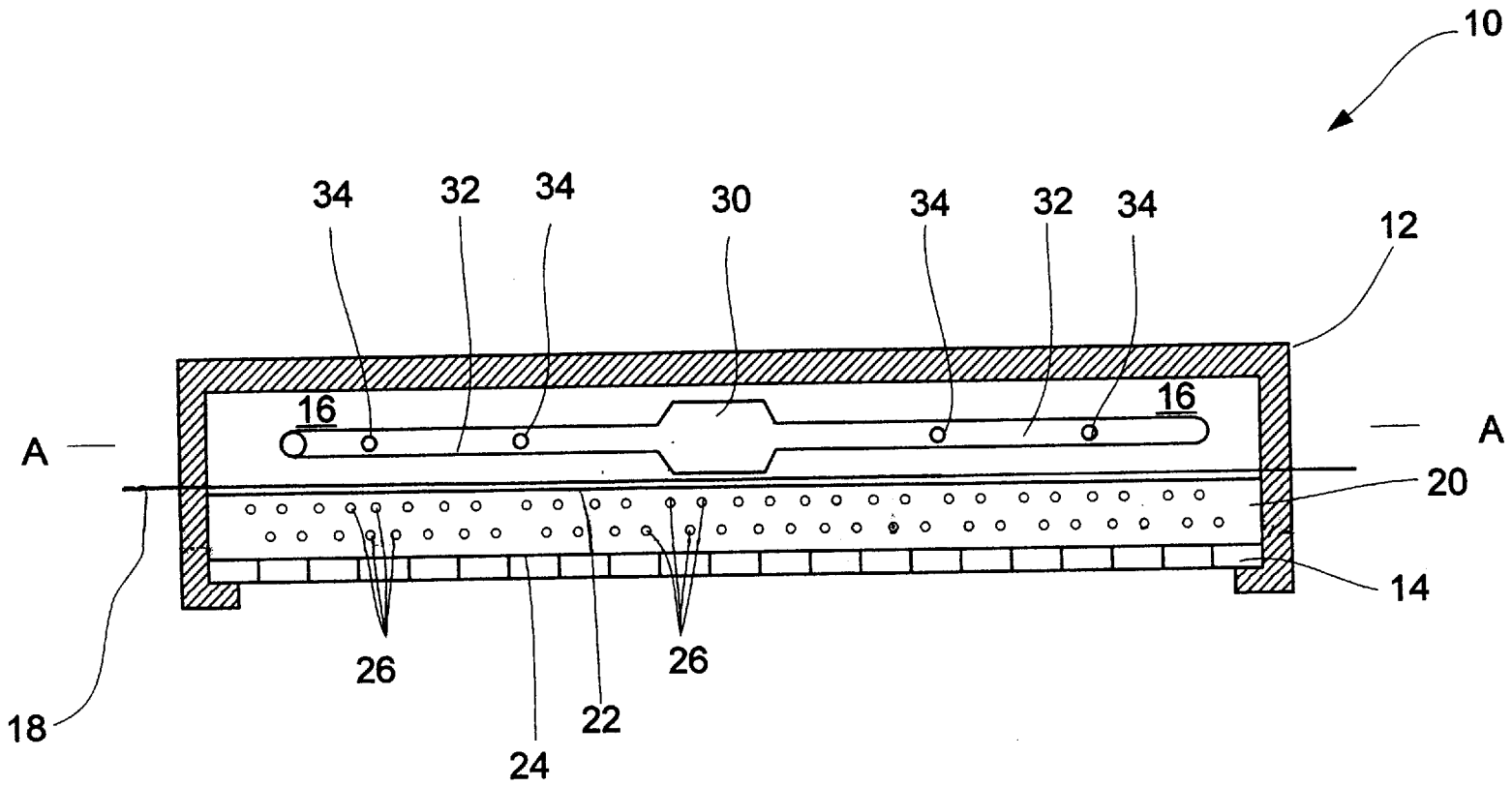
FIG. 1 is a schematic cross-sectional view of a catalytic heater.

Referring now to the drawings, FIG. 1 is a schematic cross section through a catalytic heater 10 of the present invention. A housing 12 encloses a grate 14 that supports a catalyst support 20. Catalyst support 20 is a thin block of a porous substance, preferably woven fibers of crystalline silica or crystalline alumina, such as those manufactured by Carborundum Company Ltd., Mersey, England. The specific surface area of this material typically is between 4.5 $m^2/g$ and 6.5 $m^2/g$. Catalyst support 20 has a distal side 24 adjacent to grate 14 and a proximal side 22 opposite distal side 24. Catalyst support 20 preferably is between 1 cm and 2 cm thick, so that air reaching distal side 24 via grate 14 can diffuse throughout catalyst support 20 in a high enough concentration to support combustion. Above catalyst support 20 is a fuel delivery system 30 that includes several distribution pipes 32 parallel to proximal side 22 of catalyst support 20. The remaining volume within housing 12 is filled by fiber insulation 16. Distribution pipes 32 have apertures 34 through which gaseous fuel leaves fuel delivery system 30 and diffuses through fiber insulation 16 to catalyst support 20.

Supported on catalyst support 20 is a catalyst, represented schematically by circles 26. Catalyst 26 preferably is cobalt chromium oxide spinel, having a chemical formula $(Co^{2+})_A(CO^{3+}{}_{2\delta}Cr^{3+}{}_{2-2\delta})_B O^{2-}{}_4$, where δ is the fraction of $Co^{+3}$ ions in the octahedral sublattice of the spinel, and A and B denote the tetrahedral and octahedral sublaticces, respectively. Typically, 30% by weight of catalyst support 20 consists of catalyst 26. With this proportion of catalyst 26 in catalyst support 20, the energy output of heater 10 is between 2 Watts and 5 Watts per $cm^2$ of catalyst support 20.

Cobalt chromium oxide spinel catalyst 26 is deposited on catalyst support 20 by the following steps:

1. Dissolve $Cr(NO_3)_3.9H_2O$ and $Co(NO_3)_2.6H_2O$ in water, in a proportion that gives the desired stoichiometry after calcination.

2. Saturate the support material with the chromium nitrate-cobalt nitrate solution.

3. Dry the impregnated support material at 100° C.–110° C. for 10–12 hours.

4. Calcination: heat the dried support material at a rate of 5° C.–10° C. per minute to a calcination temperature of 600° C.–650° C. Maintain the calcination temperature for 3–5 hours.

Alternatively, one or more soluble salts of alkali metals, alkaline earth metals, or iron may be added to the solution of step 1 to increase the stability of the catalyst.

An electrically conductive wire 18 runs across proximal surface 22 of catalyst support 20. The purpose of wire 18 is to heat catalyst support 20 to initiate the combustion of fuel catalyzed by catalyst 26. Preferably, wire 18 is a nichrome wire about 1 mm in diameter. An electrical switch with a timer (not shown) provides electrical current to wire 18. Running a current of about 10 amps through wire 18 for between two minutes and three minutes typically is sufficient to heat catalyst support 20 to the temperature of between 200° C. and 350° C. needed to initiate combustion. After combustion is initiated, it is self-supporting.

Although catalyst support 20 and grate 14 are depicted as being flat in FIG. 1, the scope of the present invention includes catalyst supports 20 and grates 14 that are curved to suit particular applications. For example, distal surface 24 of catalyst support 20 may have a spheroidal or paraboloidal shape, to focus the infrared radiation emitted therefrom onto a target.

Figure 2:
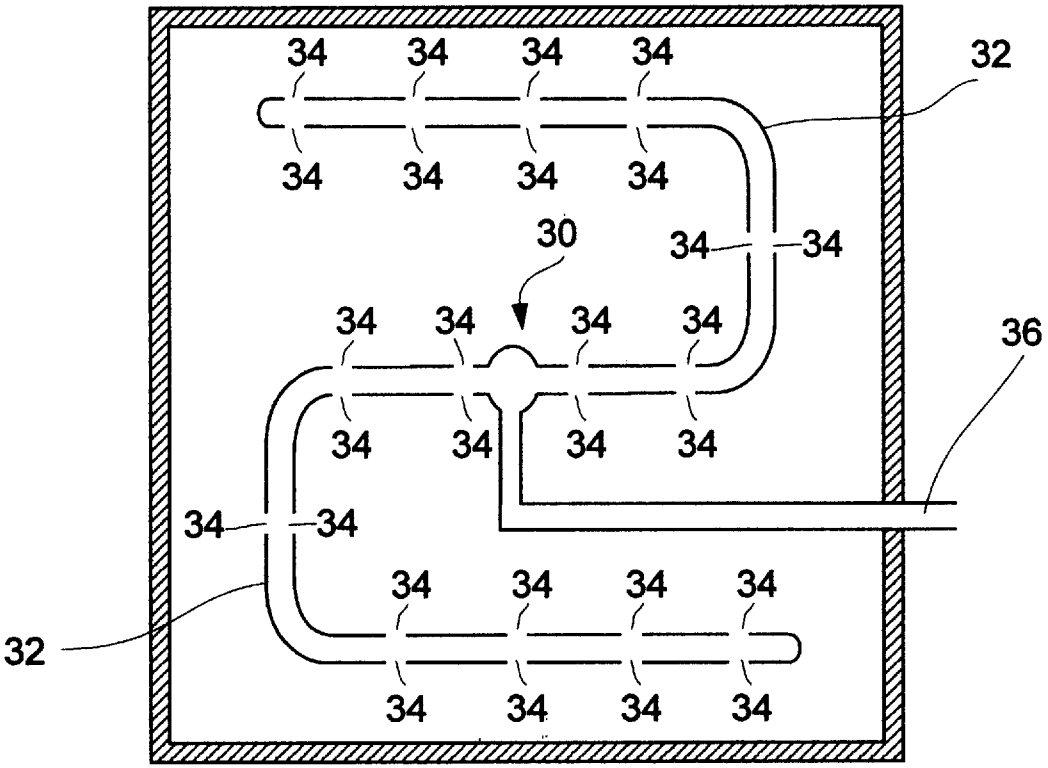
FIG. 2 is a cross-sectional view through section A—A of the catalytic heater of FIG. 1.

FIG. 2 is a cross section through heater 10 along cut A—A, i.e., through fuel delivery system 30. FIG. 2 shows, in addition to distribution pipes 32 with their apertures 34, a delivery pipe 36 through which gaseous hydrocarbon fuel is introduced to heater 10.

Using a mixture of propane and butane as fuel, a heater of the present invention whose catalyst support 20 has an area of 1200 $cm^2$ produces 3 Kilowatts of heat.

Figure 3:
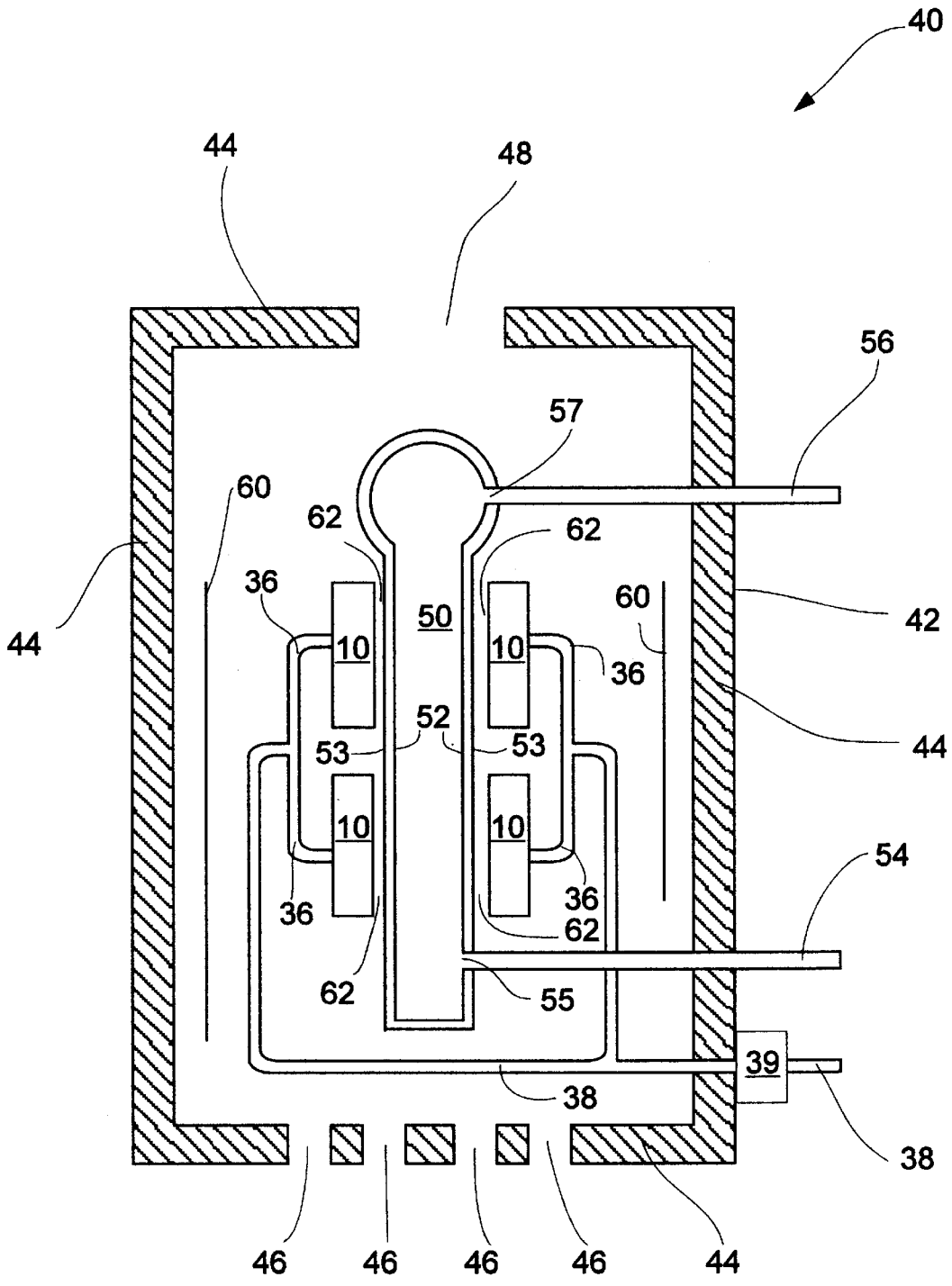
FIG. 3 is a schematic cross section of a boiler based on the catalytic heater of FIG. 1.

FIG. 3 is a schematic cross section of a boiler 40 according to the present invention. A hollow fluid chamber 50, defined by a chamber wall 52 having an outer surface 53, is flanked by four heaters 10. Heaters 10 are mounted with distal sides 24 of their catalyst supports 20 facing towards chamber 50, so that infrared radiation, emitted by catalyst supports 20 as fuel and air react on catalyst 26, impinges on chamber 50, thereby heating the fluid contained in chamber 50; and with gaps 62 separating heaters 10 from chamber 50 so that air can diffuse freely to catalyst 26. Preferably, outer surface 53 is colored black, to promote the absorption of infrared radiation by chamber 50. Infrared radiation that is radiated away from chamber 50 is reflected back to chamber 50 by a reflector 60 that surrounds chamber 50 and heaters 10.

A fluid inlet line 54 connects to chamber 50 at a fluid inlet port 55 to introduce fluid to be heated into chamber 50. A fluid outlet line 56 connects to chamber 50 at a fluid outlet port 57 to allow heated fluid to leave chamber 50. Preferably, the fluid to be heated is fed continuously into chamber 50 via fluid inlet line 54 and heated fluid is obtained continuously from chamber 50 via fluid outlet line 56. A fuel inlet line 38 connects to delivery pipes 36 to introduce fuel into heaters 10. Optionally, fuel inlet line 38 passes through an auxiliary catalytic/adsorbing unit 39 wherein sulfurcontaining compounds are removed from the fuel. Preferably, boiler 40 is oriented as shown in FIG. 3, with fluid inlet port 55 at a lower level than fluid outlet port 57, so that fluid can rise from fluid inlet port 55 to fluid outlet port 57 as the fluid is heated.

Chamber 50, heaters 10 and reflector 60 are enclosed in a housing 42 defined by several walls 44 that preferably are made of a heat-insulating material. One of walls 44 is pierced by apertures 46. Another of walls 44 is pierced by aperture 48. With boiler 40 oriented as shown in FIG. 3, apertures 46 serve to admit air for combustion and aperture 48 serves as an exit aperture for hot combustion product gases.

While the invention has been described with respect to a limited number of embodiments, it will be appreciated that many variations, modifications and other applications of the invention may be made.

What is claimed is:

1. A boiler for heating a fluid by infrared radiation from a catalytic reaction of a gaseous hydrocarbon fuel and atmospheric oxygen, comprising:

(a) a chamber, for the fluid, having a wall; and (b) a catalytic heater operative to react the fuel and the atmospheric oxygen at a temperature between about 400° C. and about 750° C., including:

(i) a porous and fibrous catalyst support, having a proximal side, and having a distal side wherethrough the atmospheric oxygen diffuses towards said proximal side, (ii) a particulate catalyst, for the reaction, deposited on said porous and fibrous catalyst support, (iii) a mechanism for delivering the fuel to said proximal side of said catalyst support, and (iv) a mechanism for heating said catalyst support, thereby initiating the reaction of the fuel and the atmospheric oxygen; said heater being mounted outside said chamber with said distal side of said catalyst support facing said chamber, said distal side of said catalyst support and said wall of said chamber defining a gap therebetween.

2. The boiler of claim 1, further comprising:

(c) a housing, enclosing said chamber and said heater, and having a plurality of housing walls, at least one of said housing walls having at least one aperture wherethrough air enters said housing.

3. The boiler of claim 1, wherein said wall of said chamber has an outer surface, at least part of said outer surface being colored black.

4. The boiler of claim 1, wherein said catalyst support includes a woven sheet of fibers of a material selected from the group consisting of silica and alumina.

5. The boiler of claim 1, wherein said catalyst includes cobalt chromium oxide spinel.

6. The boiler of claim 1, wherein said mechanism for delivering the fuel includes a pipe running substantially parallel to said proximal side of said catalyst support and having a plurality of apertures wherethrough the fuel exits said pipe.

7. The boiler of claim 1, wherein said mechanism for heating said catalyst support includes an electrically conductive wire adjacent to said proximal side of said catalyst support.

8. The boiler of claim 1, further comprising:

(d) a reflector, at least partially surrounding said chamber and said heater.

9. A method for heating a fluid, comprising the steps of:

(a) introducing the fluid into a chamber;

(b) providing a catalytic heater wherein a gaseous hydrocarbon fuel reacts catalytically with atmospheric oxygen at a temperature between about 400° C. and about 750° C., said heater including:

(i) a porous and fibrous catalyst support having a proximal side, and having a distal side wherethrough said atmospheric oxygen diffuses towards said proximal side, (ii) a particulate catalyst, for said reaction, deposited on said porous and fibrous catalyst support, (iii) a delivery mechanism for delivering the fuel to said proximal side of said catalyst support and (iv) a heating mechanism for heating said catalyst support, thereby initiating the reaction of said fuel and said oxygen;

(c) mounting said heater outside said chamber so that said distal side of said catalyst support faces said chamber, there being a gap between said distal side of said catalyst support and said chamber; and (d) introducing said fuel to said catalyst support via said delivery mechanism, said reaction of said fuel with said atmospheric oxygen then heating said chamber and the fluid therein at least in part by radiation.

10. The method of claim 9, wherein said chamber has an inlet port, wherethrough the fluid is introduced to said chamber, and an outlet port, wherethrough heated fluid exits said chamber, the method further comprising the step of:

(e) positioning said chamber so that said inlet port is at a lower level than said outlet port.

11. The method of claim 9, further comprising the step of:

(f) heating said catalyst support to a temperature of between about 200° C. and about 350° C., thereby initiating said reaction.

12. The method of claim 11, wherein said heating mechanism includes an electrically conductive wire adjacent to said proximal side of said catalyst support, said heating of said catalyst support being effected by introducing an electric current into said wire.

* * * * *